US007162775B2

(12) United States Patent
Hoffman

(10) Patent No.: US 7,162,775 B2
(45) Date of Patent: Jan. 16, 2007

(54) BOOT COVER HINGE

(75) Inventor: Lawrence Andrew Hoffman, Portland, OR (US)

(73) Assignee: The Hoffman Group, LLC, Portland, OR (US)

( * ) Notice: Subject to any disclaimer, the term of this patent is extended or adjusted under 35 U.S.C. 154(b) by 0 days.

(21) Appl. No.: 10/982,686

(22) Filed: Nov. 4, 2004

(65) Prior Publication Data

US 2005/0125953 A1 Jun. 16, 2005

Related U.S. Application Data

(60) Provisional application No. 60/518,130, filed on Nov. 4, 2003.

(51) Int. Cl.
*E05D 3/06* (2006.01)

(52) U.S. Cl. ..... 16/366; 16/371; 16/376

(58) Field of Classification Search ..... 16/366, 16/371 X, 376 X, 327, 328; 180/69.21, 180/69.2; 49/381, 398, 400, 401; 296/55, 296/59, 100.06
See application file for complete search history.

(56) References Cited

U.S. PATENT DOCUMENTS 3,330,593 A * 7/1967 Pollak ..... 296/76
3,643,775 A * 2/1972 Kittel et al. ..... 400/317.3
5,004,287 A * 4/1991 Doyle ..... 296/57.1
6,609,583 B1 * 8/2003 Schillaci et al. ..... 180/69.21
6,904,826 B1 * 6/2005 Hesener ..... 74/483 R

OTHER PUBLICATIONS 8 pages of screen shots from flipfloptrunk.com website showing images of flip lid trunk for Grand AM's; 2 pages showing FAQs regarding the trunk lids.

* cited by examiner

*Primary Examiner*—Brian E. Glessner
*Assistant Examiner*—Mark Williams
(74) *Attorney, Agent, or Firm*—Silicon Forest Patent Group; Paul J Fordenbacher, Esq.

(57) ABSTRACT

A trunk lid hinge in accordance with embodiments of the present invention provide the ability to operate a trunk of an automobile in a conventional manner as well as in an unconventional manner about two pivot axes. The trunk lid hinge comprises a hinge mount, a hinge bracket, and a locking element. The hinge mount is an elongated member having a mount first end and a mount second end opposite the mount first end. The hinge bracket is pivotally coupled to the mount second end and is adapted to be positioned at and between a first pivot position and a second pivot position about a pivot axis in addition to the stock pivot axis. Embodiment of the present invention permit the automobile enthusiast to retrofit the conventional trunk lid to operate as in an unconventional manner and allow the automobile manufacturers to incorporating trunk lids in automobiles with unconventional opening characteristics without requiring major redesign of the current trunk lids.

2 Claims, 7 Drawing Sheets

BOOT COVER HINGE

RELATED APPLICATION

This application is a non-provisional application claiming benefit under 35 U.S.C. § 121 of U.S. Provisional Application No. 60/518,130, filed Nov. 4, 2003.

FIELD OF THE INVENTION

This invention generally relates to motor vehicles, and more particularly, hinges for a boot or trunk lid of a motor vehicle.

BACKGROUND OF INVENTION

The aggressively competitive automobile industry continuously strives to provide new and exciting features to the new model automobiles. A focus toward style, creature comforts and safety has been a major factor in differentiating one competitor's products from others and premium models from budget models.

With many automobile owners not satisfied with the style, quality, and availability of the features provided by the automakers, owners have turned to aftermarket component manufacturers and even automobile kit manufacturers for satisfaction. The owners of hot rod, street rod, and classic automobiles are always looking for ways to customize and differentiate their cars from others, and styling, shape and form are high on the list of attributes that these owners wish to improve.

One aspect of the automobile that has changed little is the flip-up trunk lid. FIGS. 1A and 1B are side views of an automobile 10 with a known flip-up trunk lid 12, in a closed position and an open position, respectively. FIG. 1C is a side view of a known hinge mechanism 16 for the flip-up trunk lid 12. The trunk lid 14 comprises a front edge 15 and an opposite rear edge 17. The hinge mechanism 16 includes a pair of hinge brackets 18 and a pair of hinge arms 20. Each hinge bracket 18 is coupled spaced-apart to a body panel 11 inside of the trunk 13. Each of the hinge arms 20 include a trunk lid end 21 and a hinge end 22 opposite the trunk lid end 21. The trunk lid ends 21 are coupled to the trunk lid 14 spaced-apart and adjacent the front edge 15 and the hinge ends 22 are pivotally coupled to respective hinge brackets 18 defining a common pivot axis A.

The flip-up trunk lid 12 is suspended from the automobile 10 such that the trunk lid 14 pivots about the pivot axis A moving from a generally horizontal orientation in the closed position to a generally vertical position in the open position.

The hinge arms 20 are formed into a preferred shape to provide an extension necessary to permit the hinge brackets 18 to be mounted inside the trunk 13 while allowing the trunk lid 14 to pivot and clear the trunk opening 19. The preferred shape of the hinge arms 20 is adapted to extend the front edge 15 of the trunk lid 14 upward so as to clear the trunk opening 19 and other structures of the automobile 10, such as the rear windscreen. The stock hinge arm 20 shape can also act as a counter-weight to preferentially balance the trunk lid 14 so as to make the operation of the trunk lid 14 easier.

The hinge arms 20 are commonly manufactured from square or rectangular steel tubing that define a substantially square or rectangular bore cross-section, respectively.

The common pivot axis A permits rotation of the trunk lid 14 only within one plane. As the trunk lid 14 is opened, the rear trunk lid edge 17 swings up from the automobile 10 in a substantially vertical plane, whereby a space for access into the trunk 13 is formed like a clam shell with the trunk lid 14 pivoting up and toward the front of the automobile 10.

Many automobile enthusiasts consider it highly desirable to incorporate exotic features into their ordinary stock automobiles. Modifying the opening characteristics of the flip-up trunk lid 12 has, for the most part, been out of reach of the aftermarket enthusiast.

Accordingly, there is a need in the art to have components and assemblies that provide automobile manufacturers and aftermarket enthusiasts the ability to impart various opening characteristics to the flip-up trunk lid of currently designed automobiles without major modification to the automobile body or trunk lid structures.

SUMMARY OF INVENTION

A trunk lid hinge in accordance with embodiments of the present invention provide the ability to operate a trunk of an automobile in a conventional manner as well as in an unconventional manner about two pivot axes. The trunk lid hinge comprises a hinge mount, a hinge bracket, and a locking element. The hinge mount is an elongated member having a mount first end and a mount second end opposite the mount first end. The hinge bracket is pivotally coupled to the mount second end and is adapted to be positioned at and between a first pivot position and a second pivot position about a pivot axis in addition to the stock pivot axis. Embodiment of the present invention permit the automobile enthusiast to retrofit the conventional trunk lid to operate as in an unconventional manner and allow the automobile manufacturers to incorporating trunk lids in automobiles with unconventional opening characteristics without requiring major redesign of the current trunk lids.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentality's, procedures, and combinations particularly pointed out in the appended claims.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 1A:
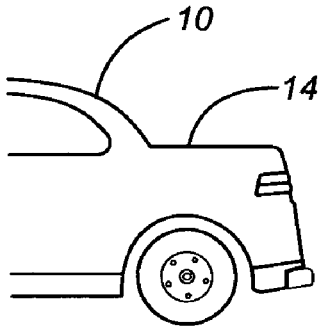
Fig. 1A (Prior Art)
FIGS. 1A and 1B are side views of an automobile with a known flip-up trunk lid, in a closed position and an open position, respectively.
Figure 1B:
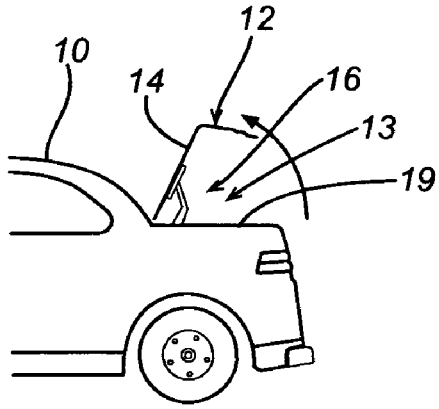
Fig. 1B (Prior Art)
Figure 1C:
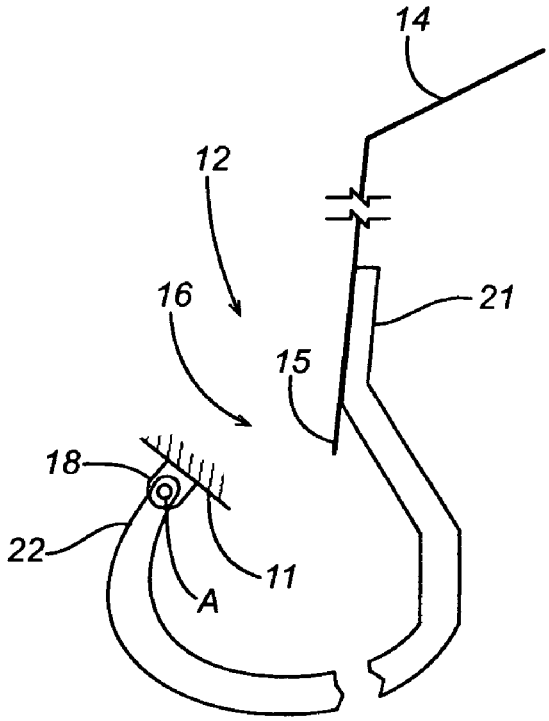
Fig. 1C (Prior Art)
FIG. 1C is a side view of a known hinge mechanism for the flip-up trunk lid.
Figure 2A:
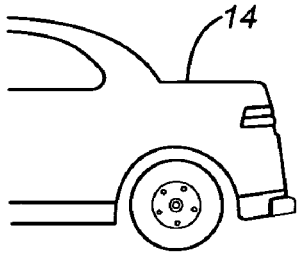
FIGS. 2A–2D are side views a truck lid in various positions in the opening of the trunk lid in accordance with an embodiment of the present invention.
Figure 2C:
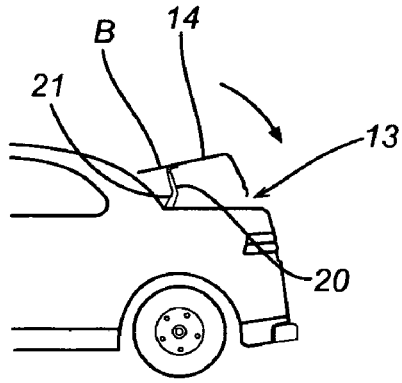
Figure 2B:
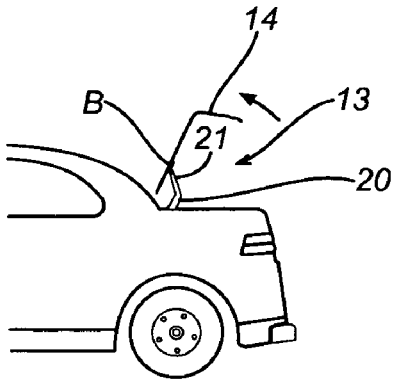
Figure 2D:
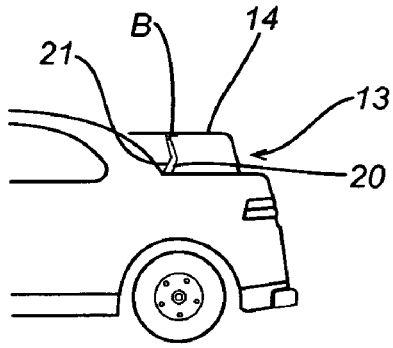

FIGS. 2A–2D are side views of a truck lid in various positions in the opening of the trunk lid 14 in accordance with an embodiment of the present invention. FIG. 2A shows the truck lid 14 in the closed position. FIG. 2B shows the trunk lid 14 in a first open position recognized as the known flip-up trunk lid 12 pivoting about a pivot axis A located within the trunk 13, as shown in FIG. 1C. FIGS. 2C and 2D show the trunk lid 14 pivoting to a second open position about a second pivot axis B located adjacent the trunk lid end 21 of the hinge arms 20. The second open position provides the trunk lid 14 positioned generally horizontal providing a unique, aesthetically and functionally pleasing, orientation.

Figure 3A:
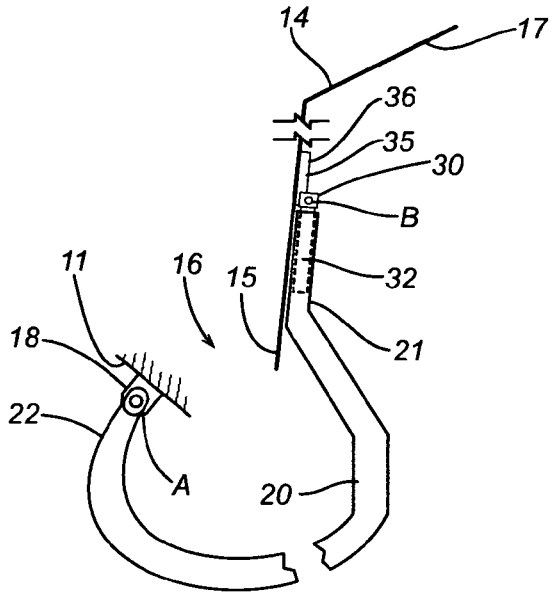
FIGS. 3A and 3B are side views of a trunk lid, a hinge mechanism, and a trunk lid hinge coupled to the stock trunk hinge mechanism, in a first open position and a second open position, respectively, in accordance with an embodiment of the present invention.
Figure 3B:
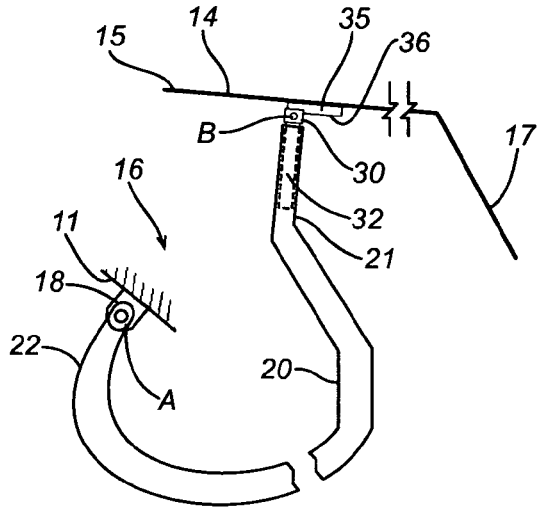

FIGS. 3A and 3B are side views of a trunk lid 14, a hinge mechanism 16, and a trunk lid hinge 30 coupled to the stock trunk hinge mechanism 16, in a first open position and a second open position, respectively, in accordance with an embodiment of the present invention. The trunk lid 14 comprises a front edge 15 and an opposite rear edge 17. The stock trunk hinge mechanism 16 includes a pair of hinge brackets 18 and a pair of hinge arms 20, one of each is shown. The hinge bracket 18 is coupled to a body panel 11 inside of the trunk 13. The stock hinge arm 20 includes a trunk lid end 21 and a hinge end 22 opposite the trunk lid end 21. The trunk lid end 21 is coupled to a trunk lid hinge 30 which defines a second pivot axis B. The trunk lid hinge 30 is coupled to the trunk lid 14 adjacent the front edge 15. The hinge end 22 is pivotally coupled to the hinge bracket 18 defining a pivot axis A.

The trunk lid 14 is suspended from the automobile 10 such that the trunk lid 14 pivots about the pivot axis A moving from a generally horizontal orientation in the closed position to a generally vertical orientation in a first open position as shown in FIGS. 2A and 2B. The trunk lid hinge 30 is adapted to provide pivoting of the trunk lid 14 about the second pivot axis B to a second open position moving from a generally vertical orientation to a generally horizontal orientation, as shown in FIGS. 2C and 2D.

Figure 4:
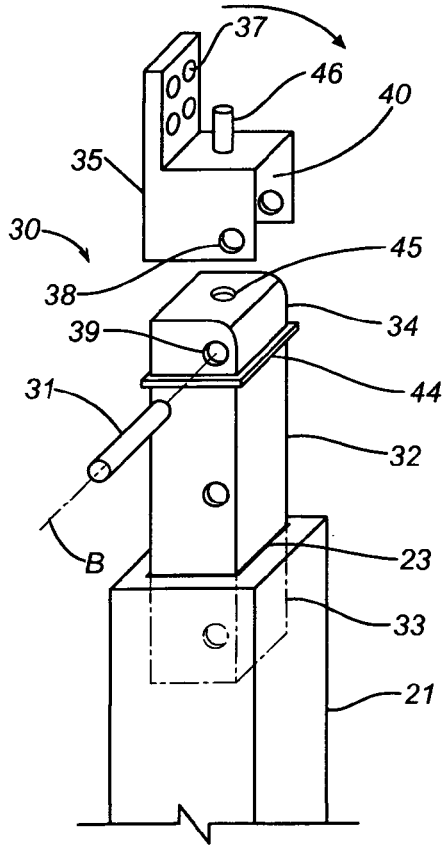
FIG. 4 is a perspective view of a trunk lid hinge in accordance with an embodiment of the present invention.

FIG. 4 is a perspective exploded view of a trunk lid hinge 30 in accordance with an embodiment of the present invention. The trunk lid hinge 30 comprises a hinge mount 32, a hinge bracket 35, and a locking element 46. The hinge mount 32 is an elongated member having a mount first end 33 and a mount second end 34 opposite the mount first end 33. The hinge bracket 35 is pivotally coupled to the mount second end 34 and is adapted to be positioned at and between a first pivot position and a second pivot position about second pivot axis B.

The hinge bracket 35 comprises a flange 36 adapted to couple with the trunk lid 14. The hinge bracket 35 comprises a plurality of through holes 37 adapted to receive a suitable fastener, such as, but not limited to, bolts and screws. In other embodiments in accordance with the present invention, the hinge bracket 35 is coupled to the trunk lid 14 by any suitable means, such as, but not limited to, welding and brazing, negating the need for through holes 37.

The hinge bracket 35 further comprises a bracket hinge-pin bore 38. The hinge mount second end 34 comprises a mount hinge-pin bore 39. The hinge bracket 35 and the hinge mount second end 34 are adapted to engage pivotally coupled with axial alignment of the bracket hinge-pin bore 38 and the mount hinge-pin bore 39 with a hinge pin 31 therethrough. In an embodiment, the hinge bracket 35 provides a bore or sleeve 40 adapted to accept the hinge mount second end 34 therein.

Figure 5A:
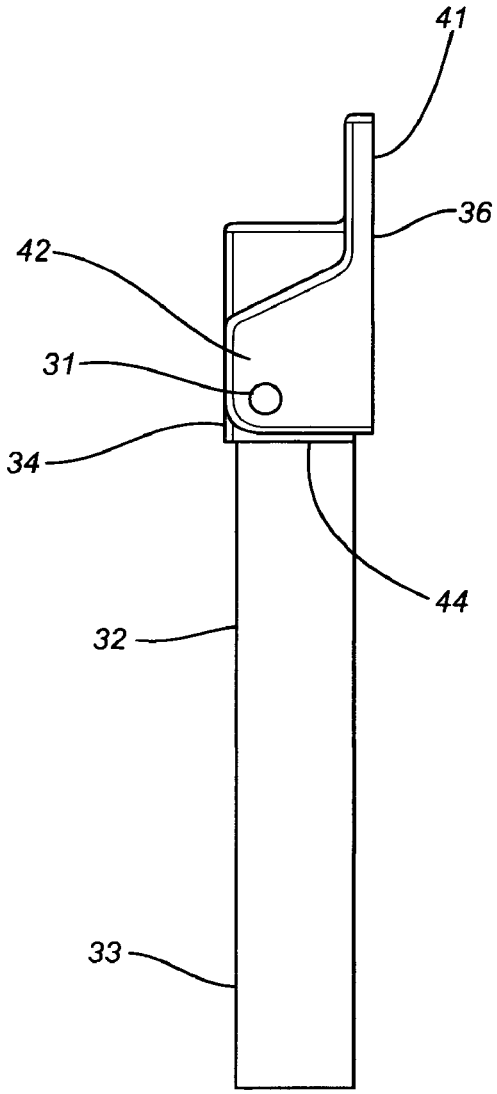
FIGS. 5A and 5B are side and front views of another embodiment of the hinge bracket wherein the hinge bracket forms a sleeve that surrounds the hinge mount second end on three sides.
Figure 5B:
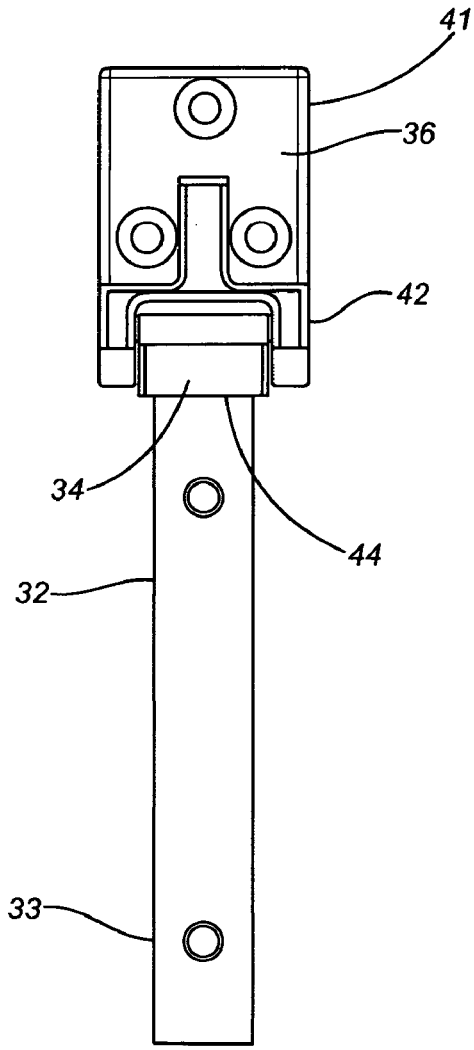

FIGS. 5A and 5B are side views of another embodiment of the hinge bracket 41 wherein the hinge bracket 41 forms a sleeve 42 that surrounds the hinge mount second end 34 on three sides.

In an embodiment, the hinge mount second end 34 is rounded to facilitate pivoting the hinge bracket 41 about the hinge pin 31 to a predetermined amount without being hindered by impacting the hinge mount second end 34. It is understood that there are many suitable configurations wherein the hinge bracket 41 and hinge mount 32 may be pivotally coupled.

The hinge mount 32 and the hinge bracket 41 pivot, generally, from a first pivot position wherein the flange 36 is substantially parallel with the hinge mount 32, to a second pivot position wherein the flange 36 is substantially perpendicular to the hinge mount 32, as shown in FIGS. 3A and 3B. Wherein the flange 36 is substantially parallel with the hinge mount 32, the trunk lid 14 is orientated in the standard flip-up position, as shown in FIGS. 2A and 2B. Wherein the flange 36 is substantially perpendicular with the hinge mount 32, the trunk lid 14 is orientated in the horizontal position, second open position, as shown in FIG. 2D.

The mount first end 33 is adapted to be slidingly received into the bore 23 of the stock hinge arm 20 at the trunk lid end 22 and then coupled thereto such as, but not limited to, bolts and welding. Stock hinge arms 20 are commonly manufactured from square or rectangular steel tubing that define a substantially square or rectangular bore cross-section, respectively. In embodiments in accordance with the present invention, the mount first end 33 comprises a complimentary cross-section so as to be inserted into the bore 23 of the stock hinge arms 20. In another embodiment, the hinge mount 32 comprises a stop 44 lip that is larger than the bore 23 and about the trunk lid end 22 to prevent over-insertion of the hinge mount 32 into the bore 23.

The trunk lid hinge 30 further comprises a locking element 46 adapted to control the pivoting of the hinge bracket 41; from freely pivoting to fixed. The locking element 46 is coupled to the hinge bracket 41 and is adapted to engage the hinge bracket 41 and the hinge mount 32 so as to prevent rotation about the hinge pivot 31 wherein the trunk lid 14 is orientated in the first open position as shown in FIG. 2B. This facilitates the normal opening and closing of the trunk lid 14 shown in FIGS. 2A and 2B. The locking element 46 is adapted to disengage so as to permit the pivoting of the trunk lid hinge 30 from the first position to the second position such as shown in FIGS. 3A and 3B.

Figure 6A:
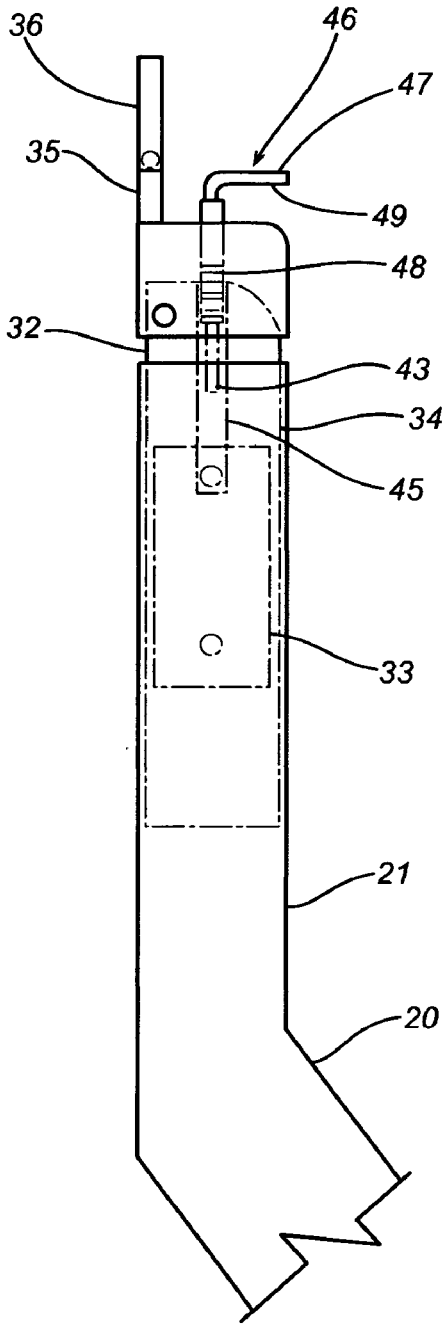
FIG. 6A is a side view of a locking element comprising a pin and a biasing member, in accordance with and embodiment of the present invention.

FIG. 6A is a side view of a locking element 46 comprising a pin 47 and a biasing member 48, in accordance with and embodiment of the present invention. The pin 47 comprises a pin first end 49 and a pin second end 43 opposite the pin first end 49. The biasing member 48 couples the pin 47 to the hinge bracket 35 and exerts biasing force on the pin 47 when the pin 47 is pulled into the disengaged position. In the engaged position, the pin second end 43 extends a predetermined distance from the hinge bracket 35 and, when the flange 36 is generally parallel with the hinge mount 32, the pin second end 43 is slidably received into a locking pin aperture 45 or bore in the hinge mount second end 34.

The locking pin first end 49 is adapted to provide a handle to allow the user to grab and pull the locking pin 46 out of engagement with the hinge mount 32 to permit pivoting of the trunk lid 14 as shown in FIGS. 3A and 3B. In an embodiment, the locking pin second end 43 is adapted to ride against the hinge mount second end 34 and be urged to the engaged position, when the flange 36 is pivoted back towards parallel orientation with the hinge mount 32, and is urged into the locking aperture 45 when returned to the first position.

Figure 6B:
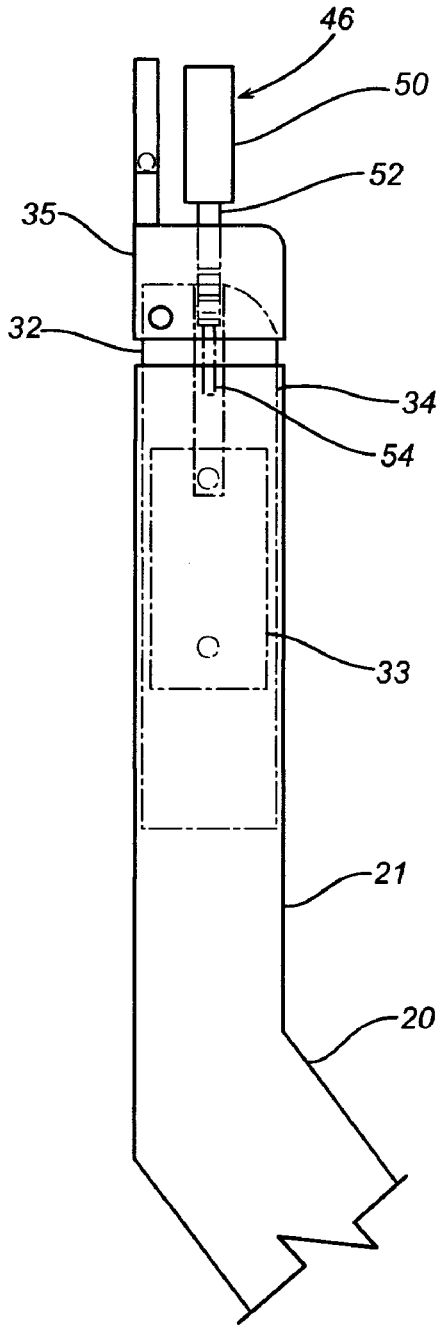
FIG. 6B is a side view of a locking element comprising a solenoid including an actuator pin, in accordance with and embodiment of the present invention.

FIG. 6B is a side view of a locking element 46 comprising a solenoid 50 including an actuator pin 52, in accordance with an embodiment of the present invention. The actuator pin 52 has an engagement end 54. The solenoid 50 is adapted, with the activation of an electrical switch, to release the actuator pin 52 from engagement with the hinge mount 32 when in the disengaged position and the engagement end 54 extends from the bracket 35 a predetermined distance when in the engaged position.

In assembly, the trunk lid 14 is removed from the hinge arm 20. The mounting bracket 35 is coupled to the trunk lid 14 with suitable fasteners coupling the flange 36 to the trunk lid 14. The hinge mount 32 is slidably inserted into the stock hinge arm 20 at the trunk lid end 21 and coupled thereto.

Referring again to FIGS. 2A–D, the trunk lid 14 is operated in accordance with an embodiment of the present invention. FIG. 2A shows the trunk lid 14 in the closed position wherein the locking element 46 is engaged with the hinge mount second end so as to prevent pivoting about the second axis B defined by the trunk lid hinge 30. The trunk lid 14 is opened in the usual manor to pivoting about the stock hinge mechanism 16 about the first pivot axis A until the trunk lid 14 is substantially in the first open position. The locking element engagement end 54 is disengaged from the hinge mount second end 34 and the trunk lid 14 is pivoted about the second pivot axis B about the trunk lid hinge 30. The trunk lid 14 is now free to be positioned in the horizontal orientation providing a unique, aesthetically and functionally pleasing orientation.

The trunk lid 14 is closed by the reverse of the method above. The trunk lid 14 is pivoted about the trunk lid hinge 30 from the second open position to the first open position, wherein the locking element 46 becomes engaged with the hinge mount 32 to prevent further pivoting about the trunk lid hinge 30. The trunk lid 14 is thereafter closed in the conventional way.

Figure 7A:
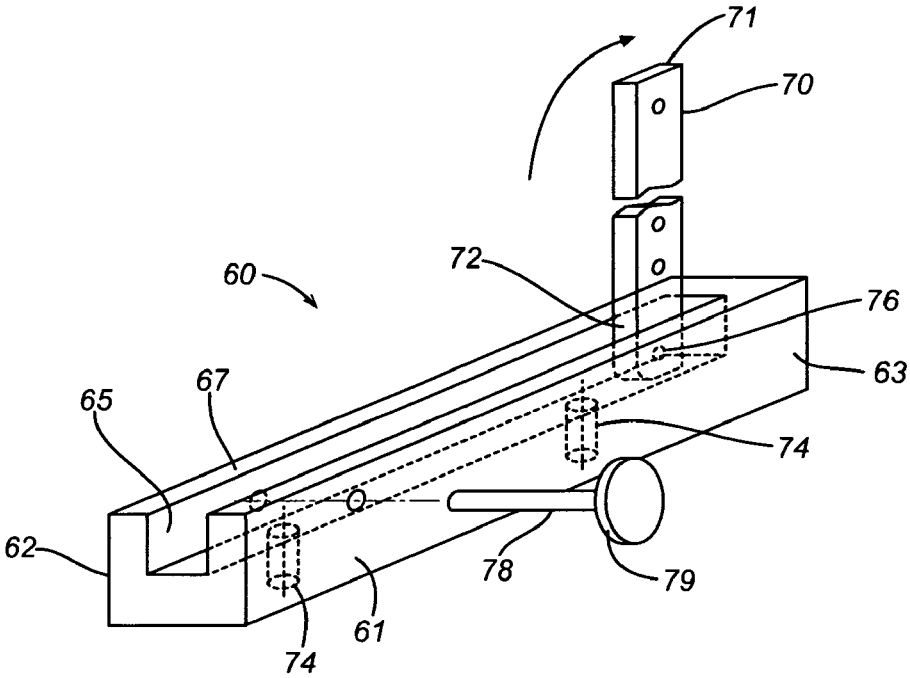
FIGS. 7A and 7B are perspective views of a trunk lid hinge in a first and second pivot position, respectively, in accordance with another embodiment of the present invention.
Figure 7B:
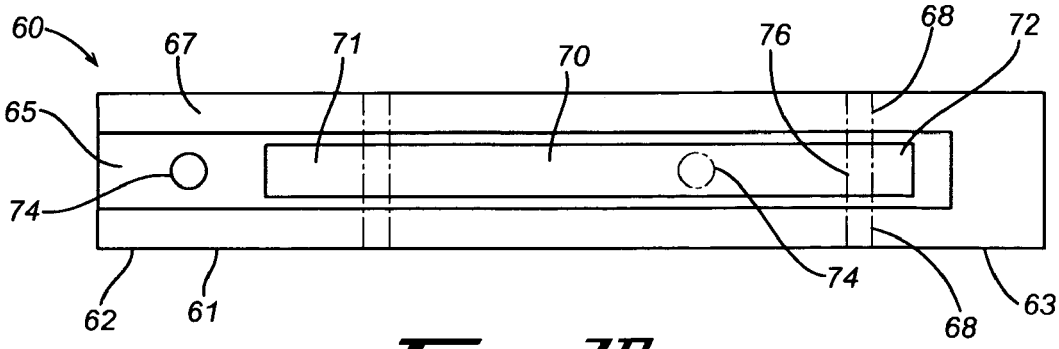

FIGS. 7A and 7B are perspective and top views, respectively, of a trunk lid hinge 60 in a first and second pivot position, respectively, in accordance with another embodiment of the present invention. The trunk lid hinge 60 comprises a hinge mount 62, a hinge bracket 70, and a locking element 66. The hinge mount 62 is an elongated member having a mount first end 61 and a mount second end 63 opposite the mount first end 61. The hinge mount 62 further comprises a groove 65 along a mount first side 67 at least partially between the mount first end 61 and mount second end 63. The groove 65 is adapted to receive the hinge bracket 70 therein.

Figure 8A:
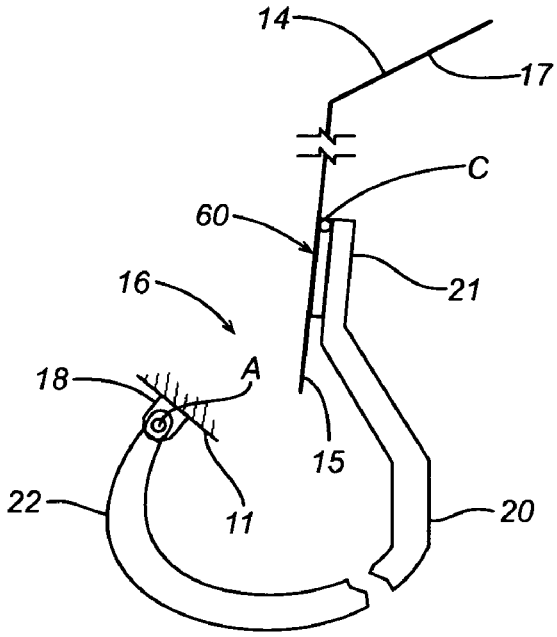
FIGS. 8A and 8B are side views of a trunk lid, a hinge mechanism, and a trunk lid hinge coupled to the stock trunk hinge mechanism in a first open position and a second open position, respectively, in accordance with an embodiment of the present invention.
Figure 8B:
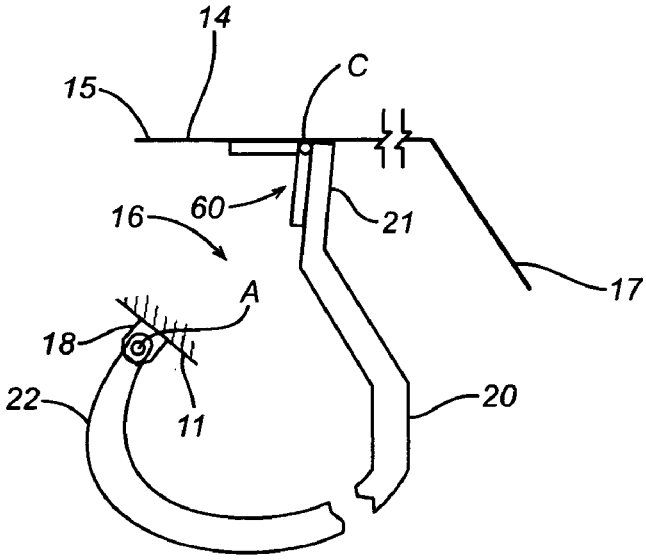

FIGS. 8A and 8B are side views of a trunk lid 14, a hinge mechanism 16, and a trunk lid hinge 60 coupled to the stock trunk hinge mechanism 16 in a first open position and a second open position, respectively, in accordance with an embodiment of the present invention. The trunk lid 14 comprises a front edge 15 and an opposite rear edge 17. The stock trunk hinge mechanism 16 includes a pair of hinge brackets 18 and a pair of hinge arms 20, one of each is shown. The hinge bracket 18 is coupled to a body panel 11 inside of the trunk 13. The stock hinge arm 20 includes a trunk lid end 21 and a hinge end 22 opposite the trunk lid end 21. The trunk lid end 21 is coupled to a trunk lid hinge 60 which defines a second pivot axis C. The trunk lid hinge 60 is coupled to the trunk lid 14 adjacent the front edge 15. The hinge end 22 is pivotally coupled to the hinge bracket 70 defining a pivot axis A.

The hinge mount 62 is adapted to couple with the stock hinge arm 20. The hinge mount 62 comprises a plurality of through holes 74 adapted to receive a suitable fastener, such as, but not limited to, bolts and screws. In another embodiment in accordance with the present invention, the hinge mount 62 is coupled to the stock hinge arm 20 by any suitable means, such as, but not limited to, welding and brazing, negating the need for through holes.

Referring again to FIGS. 7A and 7B, the hinge bracket 70 comprises a hinge bracket first end 71 and a hinge bracket second end 72 opposite the hinge bracket first end 71. The hinge bracket second end 72 is pivotally coupled to the hinge mount second end 63 within the groove 65 and is adapted to be positioned at and between a first position and a second position about second pivot axis C.

The hinge bracket 70 is adapted to couple with the trunk lid 14. The hinge bracket 70 comprises a plurality of through holes 74 adapted to receive a suitable fastener, such as, but not limited to, bolts and screws. In another embodiment in accordance with the present invention, the hinge bracket 70 is coupled to the trunk lid 14 by any suitable means, such as, but not limited to, welding and brazing, negating the need for through holes.

The hinge bracket 70 further comprises a bracket hinge pin bore 76. The hinge mount second end 63 comprises a mount hinge pin bore 68. The hinge bracket 70 and the hinge mount second end 64 are adapted to engage pivotally coupled with axial alignment of the bracket hinge pin bore 76 and the mount hinge pin bore 68 with a hinge pin 31 therethrough. In an embodiment, the hinge mount second end 63 is rounded to facilitate pivoting the hinge bracket 70 about the hinge pin 31 to a predetermined amount without being hindered by impacting the hinge mount second end 64. It is understood that there are many suitable configurations wherein the hinge bracket and hinge mount may be pivotally coupled.

The hinge mount 62 and the hinge bracket 70 pivot, generally, from a first pivot position wherein the hinge bracket 70 is substantially parallel with and nested within the groove 65 of the hinge mount 62, to a second pivot position wherein the hinge bracket 70 is substantially perpendicular to the hinge mount 62. Wherein the hinge bracket 70 is substantially parallel with the hinge mount 62, the trunk lid 14 is orientated in the standard flip-up position as shown in FIG. 8B. Wherein the hinge bracket 62 is substantially perpendicular with the hinge mount, the trunk lid 14 is orientated in the horizontal position as shown in FIG. 8B.

The trunk lid hinge 60 further comprises a locking element 66 adapted to control the pivoting of the hinge bracket 70 from freely pivoting to fixed. The locking element 66 is adapted to engage the hinge bracket 70 and the hinge mount 62 so as to prevent rotation about the hinge pivot wherein the trunk lid 14 is orientated in the standard flip-up position as shown in FIG. 8B. This facilitates the normal opening and closing of the trunk lid 14 shown in FIGS. 2A and 2B. The locking element 66 is adapted to disengage so as to permit the pivoting of the trunk lid hinge 60 from the first position to the second position such as shown in FIGS. 2B and 2D.

The locking pin first end 79 is adapted to provide a handle to allow the user to grab and pull the locking pin 78 out of engagement with the hinge mount 62 to permit pivoting of the trunk lid 14 as shown in FIGS. 2C and 2D.

The trunk lid hinge 60 comprises a material suitable to its purpose, for example, but not limited to, steel, stainless steel, chromium steel, aluminum, brass, or plastic and may be fabricated, stamped, forged, cast, molded, or assembled from one or more sub-assemblies of suitable materials.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed:

1. A trunk lid hinge for providing multi-axis pivoting of a body panel of a vehicle having a stock hinge-arm pivotally coupled to a vehicle, the trunk lid hinge comprising:

a hinge bracket adapted to couple with the body panel;

a hinge mount having a mount first-end and a mount second-end, the mount second-end pivotally coupled to the hinge bracket, the mount first-end adapted to couple to the stock hinge-arm; and a locking member coupled to the hinge bracket and adapted to have a first position adapted to engage the hinge mount to prevent pivotal rotation of the hinge mount and a second position adapted to disengage the hinge mount to allow pivotal rotation of the hinge mount, wherein the locking member comprises a solenoid comprising a housing and an actuator pin having an engagement end, the housing coupled to the hinge bracket, and the solenoid adapted to release the actuator pin when in a disengaged position, the engagement end extending from the hinge bracket a predetermined distance when in an engaged position, wherein the hinge mount further comprises an engagement aperture adapted to accept the engagement end therein when the actuator pin is in the engaged position and the body panel is in the first position.

2. A trunk lid hinge for providing two-axis pivoting of an automobile trunk lid having a hinge mechanism including a hinge arm, comprising:

a hinge mount having a mount first end and a mount second end opposite the mount first end;

a hinge bracket including a flange, the mount first end adapted to be slidingly received into the hinge arm, the hinge bracket pivotally coupled to the mount second end and adapted to be positioned in a first position and a second position, the flange adapted to couple with the trunk lid; and a locking member coupled to the hinge bracket and adapted to engage the hinge mount to prevent pivotal rotation and adapted to disengage the hinge mount to allow pivotal rotation, the locking member comprising a solenoid having a housing and an actuator pin having an engagement end, the housing coupled to the hinge bracket, and the solenoid adapted to release the actuator pin when in a disengaged position, the engagement end extending from the hinge bracket a predetermined distance when in an engaged position, wherein the hinge mount further comprises an engagement aperture adapted to accept the engagement end therein when the actuator pin is in the engaged position and the body panel is in the first position.

* * * * *